US010941029B2

(12) United States Patent
Yuse et al.

(10) Patent No.: US 10,941,029 B2
(45) Date of Patent: Mar. 9, 2021

(54) FILLING-AND-SEALING DEVICE AND FILLING-AND-SEALING METHOD

(71) Applicants: MITSUBISHI HEAVY INDUSTRIES MACHINERY SYSTEMS, LTD., Kobe (JP); TOYO SEIKAN CO., LTD., Tokyo (JP)

(72) Inventors: Hidehiko Yuse, Tokyo (JP); Kazuyuki Kurosawa, Tokyo (JP); Yukio Takada, Nagoya (JP); Shinji Ishikura, Nagoya (JP); Norio Inukai, Nagoya (JP); Katsumi Sembon, Yokohama (JP)

(73) Assignees: MITSUBISHI HEAVY INDUSTRIES MACHINERY SYSTEMS, LTD., Kobe (JP); TOYO SEIKAN CO., LTD., Tokyo (JP)

( * ) Notice: Subject to any disclaimer, the term of this patent is extended or adjusted under 35 U.S.C. 154(b) by 171 days.

(21) Appl. No.: 15/746,988

(22) PCT Filed: Aug. 22, 2016

(86) PCT No.: PCT/JP2016/003808

§ 371 (c)(1),
(2) Date: Jan. 23, 2018

(87) PCT Pub. No.: WO2017/033453

PCT Pub. Date: Mar. 2, 2017

(65) Prior Publication Data

US 2018/0215600 A1 Aug. 2, 2018

(30) Foreign Application Priority Data

Aug. 24, 2015 (JP) ..... JP2015-165227

(51) Int. Cl.
*B67C 3/10* (2006.01)
*B65B 31/02* (2006.01)
(Continued)

(52) U.S. Cl.
CPC ..... *B67C 3/10* (2013.01); *B65B 31/025* (2013.01); *B67C 3/00* (2013.01); *B67C 3/24* (2013.01);
(Continued)

(58) Field of Classification Search
CPC .... B67C 3/10; B67C 3/00; B67C 3/24; B67C 7/0013; B67C 2007/006; B67C 2007/0066; B65B 31/025; B65B 31/04
See application file for complete search history.

(56) References Cited

U.S. PATENT DOCUMENTS 5,697,203 A 12/1997 Niwa
6,457,299 B1 * 10/2002 Schwenke ..... B65B 31/025 53/110
(Continued)

FOREIGN PATENT DOCUMENTS

CN 102190263 A 9/2011
EP 1787940 A1 5/2007
(Continued)

OTHER PUBLICATIONS

India Patent Office, "Office Action for Indian Patent Application No. 201817002207," dated Oct. 14, 2019.
(Continued)

*Primary Examiner* — Jason K Niesz
(74) *Attorney, Agent, or Firm* — Manabu Kanesaka; Kenneth Berner; Benjamin Hauptman

(57) ABSTRACT

There is provided a filling-and-sealing device and a filling-and-sealing method capable of reducing an amount of use of a replacement gas used for replacing air in a container. The filling-and-sealing device includes a filling machine that fills a container with a content fluid; a sealing machine that seals the container transferred from the filling machine with a lid; a chamber that covers the filling machine and the sealing
(Continued)

machine; a gassing system that replaces, in the chamber, a gas in the container with a carbon dioxide gas by introducing the carbon dioxide gas as a second replacement gas supplied from a tank; and a pre-gassing system that replaces the gas in the container with a first replacement gas that remains in the chamber containing the carbon dioxide gas before processing by the gassing system.

18 Claims, 10 Drawing Sheets

(51) Int. Cl.

| | |
|---|---|
| ***B65B 31/04*** | (2006.01) |
| ***B67C 3/24*** | (2006.01) |
| ***B67C 3/00*** | (2006.01) |
| ***B67C 7/00*** | (2006.01) |

(52) U.S. Cl.
CPC ..... *B67C 7/0013* (2013.01); *B65B 31/04* (2013.01); *B67C 2007/006* (2013.01); *B67C 2007/0066* (2013.01)

(56) References Cited

U.S. PATENT DOCUMENTS

| | | | | |
|---|---|---|---|---|
| 2007/0107384 | A1* | 5/2007 | Capelli | B67B 1/04 53/432 |
| 2013/0078116 | A1 | 3/2013 | Washizaki et al. | |

FOREIGN PATENT DOCUMENTS

| | | | |
|---|---|---|---|
| GB | 2086834 | A | 5/1982 |
| JP | H09-323793 | A | 12/1997 |
| JP | H10-061993 | A | 3/1998 |
| JP | 2014-73855 | A | 4/2014 |
| WO | 93/23290 | A1 | 11/1993 |
| WO | 99/54208 | A1 | 10/1999 |
| WO | 2011/151902 | A1 | 12/2011 |

OTHER PUBLICATIONS

Europe Patent Office, "Search Report for European Patent Application No. 16838803.1," dated Mar. 21, 2019.

* cited by examiner

FILLING-AND-SEALING DEVICE AND FILLING-AND-SEALING METHOD

RELATED APPLICATIONS

The present application is National Phase of International Application No. PCT/JP2016/003808 filed Aug. 22, 2016, and claims priority from Japanese Application No. 2015-165227, filed Aug. 24, 2015, the disclosure of which is hereby incorporated by reference herein in its entirety.

TECHNICAL FIELD

The present invention relates to a filling-and-sealing device and a filling-and-sealing method for filling a container with a content fluid such as a beverage and sealing the container.

BACKGROUND ART

Beverage manufacturing facilities for manufacturing a container such as a can filled with a content fluid such as a beverage include, in a chamber, a filling machine that fills the container with the content fluid. In order to prevent an oxygen gas contained in air in the container from impairing quality of the content fluid, the filling machine performs gassing for blowing a replacement gas, for example, a carbon dioxide gas supplied from a tank as a supply source into the container (for example, JP2014-73855 A). For such gassing, non-seal gassing for blowing the carbon dioxide gas into the container without closing an opening of the container to expel the air in the container out of the container may be combined with seal gassing for blowing the carbon dioxide gas from a nozzle of the filling machine into the container after closing the opening of the container with the nozzle while ensuring a degassing path in the nozzle. By the gassing, the air in the container is replaced with the carbon dioxide gas, and then the container is filled with the content fluid.

The container filled with the content fluid is transferred to a sealing machine that attaches a lid to seal the container. The sealing machine performs undercover gassing for blowing the carbon dioxide gas between the lid and the container and blowing air in a head space that is a space above a fluid level in the container out of container, and then seals the container (for example, WO2011/151902 A1). A further related art is disclosed in EP 1787940 A1.

SUMMARY OF INVENTION

Technical Problem

The filling machine and the sealing machine in the conventional beverage manufacturing facility are provided in a room under the atmosphere.

Thus, even if the gassing by the filling machine replaces the air in the container with the carbon dioxide gas, a part of the carbon dioxide gas in the container leaks into the atmosphere while the container is transferred from the filling machine to the sealing machine, and thus air enters the container by an amount of the leakage. In anticipation of this, an increased amount of carbon dioxide gas is used for the gassing by the filling machine and the sealing machine, thereby achieving a requested concentration of an oxygen gas.

Not only while the container is transferred from the filling machine to the sealing machine as described above, but also during the non-seal gassing or the undercover gassing, an excessive carbon dioxide gas leaks into the atmosphere. Also, in a snifting step when the container is filled with the content fluid, a carbon dioxide gas for differential pressure of the head space leaks into the atmosphere.

Specifically, a more excessive amount of carbon dioxide gas than an amount required for keeping the requested concentration of the oxygen gas that remains in the container equal to or lower than a certain level is supplied from the supply source and used for the gassing. It is preferable to reduce an amount of use of the carbon dioxide gas in terms of cost for the carbon dioxide gas and also of safety in working environment and protection of natural environment.

Therefore, the present invention has an object to provide a filling-and-sealing device and a filling-and-sealing method capable of reducing an amount of use of a replacement gas that is required for replacing air in a container and supplied from a supply source.

Solution to Problem

As described above, a replacement gas leaking from a container during gassing, in a snifting step in filling with a content fluid, or during transfer from a filling machine to a sealing machine accumulates, for example, around the container or a region away from the container in a chamber. If the replacement gas can be collected and blown into the container, an amount of use of the replacement gas supplied from a supply source can be reduced.

A filling-and-sealing device according to the present invention achieved based on the above idea includes: a filling machine that fills a container with a content fluid; a sealing machine that seals the container transferred from the filling machine; a chamber that covers the filling machine and the sealing machine; a gassing system that replaces, in the chamber, a gas in the container with a second replacement gas based on supply from a supply source outside the chamber; and a pre-gassing system that replaces the gas in the container with a first replacement gas that remains in the chamber containing the second replacement gas before processing by the gassing system.

In the present invention, "pre-gassing" refers to introducing the gas in the chamber into the container supplied into the chamber before the processing by the gassing system.

The "second gas in the chamber" contains the first replacement gas having a higher concentration than the atmosphere.

Since the filling machine and the sealing machine are covered with the chamber, an excess of the second replacement gas blown into the container by the gassing system, or the second replacement gas leaking from inside to outside the container in a snifting step or during transfer from the filling machine to the sealing machine remains in the chamber as the first replacement gas unless forced to be discharged.

In the present invention, the first replacement gas in the chamber is introduced into the container by the pre-gassing system before the processing by the gassing system. Then, the concentration of the carbon dioxide gas in the container is higher than in the atmosphere. Thus, as compared to the case where only the second replacement gas is introduced into the container filled with the atmosphere, even a small amount of second replacement gas can keep a concentration of an oxygen gas that remains in the container equal to or lower than a certain level.

Even if the first replacement gas leaks from the container after the processing by the gassing system, and the second replacement gas in the chamber enters the container by an amount of the leakage, the second replacement gas contains the first replacement gas having a higher concentration than the atmosphere, thereby preventing a reduction in the concentration of the first replacement gas in the container.

The second replacement gas having leaked from the container before the container is sealed by the sealing machine remains in the chamber and is mixed with the gas having remained in the chamber until then to turn into the first replacement gas, which is blown into the container by the pre-gassing system.

The gassing system in the present invention can perform the gassing one or more times at any timing before and after filling with the content fluid. For example, non-seal gassing may be first performed and seal gassing may be then performed. Before the first gassing among a plurality of times of gassing, the pre-gassing system introduces the first replacement gas having remained in the chamber into the container to increase the concentration of the first replacement gas in the container, thereby reducing an amount of use of the replacement gas supplied from the supply source.

According to the present invention, almost all of the second replacement gas having once introduced into the container and leaked from the container can be collected in the chamber and again introduced into the container. This can achieve a predetermined concentration of a remaining oxygen gas while significantly reducing the amount of use of the replacement gas supplied from the supply source.

Also, the inside of the chamber is at positive pressure with respect to the atmosphere by the second replacement gas being blown out of the gassing system, thereby preventing entry of foreign matters from outside into the chamber.

The second replacement gas used in the gassing system in the present invention may be supplied in a gas phase from the supply source, or supplied in a liquid phase from the supply source.

For the former case, the second replacement gas introduced into the container remains in the container, and thus the gas in the container is replaced with the second replacement gas. On the other hand, for the latter case, a replacement liquid in a liquid phase introduced into the container is vaporized in the container, and thus the gas in the container is replaced with the second replacement gas. An example of the latter case may be nitrogen ($N_2$). If a replacement liquid as a replacement gas in the liquid phase is sprayed or dropped into the container, volume expansion caused by vaporization of the replacement liquid removes the gas in the container out of the container.

In the filling-and-sealing device according to the present invention, the pre-gassing system may include a blower that sucks the first replacement gas that remains in the chamber, and a nozzle that feeds the first replacement gas delivered by the blower into the container.

In the filling-and-sealing device according to the present invention, the pre-gassing system may introduce the gas in the chamber into the container at a position where the containers are continuously carried into the chamber.

Then, the air in the container is replaced with the first replacement gas in the chamber when the container is carried into the chamber, thereby reducing an amount of air entering the chamber through the carried container. This can reduce an amount of the second replacement gas used for keeping the inside of the chamber at a certain concentration of the second replacement gas, thereby further reducing an amount of use of the second replacement gas.

Further, the pre-gassing system preferably introduces the first replacement gas in the chamber between the containers adjacent in a carrying direction at the position where the containers are carried into the chamber. This can prevent the air that remains between the containers from entering the chamber as the containers are carried into the chamber.

In the filling-and-sealing device according to the present invention, the pre-gassing system preferably replaces the gas in the container with the first replacement gas when the second replacement gas contained in the first replacement gas reaches a predetermined concentration.

Also, in the filling-and-sealing device according to the present invention, the first replacement gas may contain the second replacement gas used for the replacement by the gassing system.

Also, in the filling-and-sealing device according to the present invention, the first replacement gas sucked by the blower in the chamber may include a flow path that passes around the chamber to the nozzle.

Further, in the filling-and-sealing device according to the present invention, the chamber may cover both the filling machine and the sealing machine, or may separately cover the filling machine and the sealing machine.

The filling-and-sealing device according to the present invention preferably includes a lid introducing portion gassing system that introduces the first replacement gas in the chamber into a position where a lid for sealing the container is carried into the chamber.

Then, when the lid is carried into the chamber, air in a lid carry-in position is replaced with the first replacement gas in the chamber, thereby preventing air outside the chamber from entering the chamber.

A filling-and-sealing device according to the present invention includes: a filling machine that fills a container with a content fluid; a sealing machine that seals the container transferred from the filling machine with a lid; a chamber that covers the filling machine and the sealing machine; a gassing system that replaces, in the chamber, a gas in the container with a second replacement gas based on a supply source outside the chamber; and a lid introducing portion gassing system that introduces a first replacement gas containing the second replacement gas into a position where the lid for sealing the container is carried into the chamber.

According to the present invention, when the lid is carried into the chamber, air in the lid carry-in position is replaced with the first replacement gas in the chamber, thereby preventing air outside the chamber from entering the chamber as the lid is carried into the chamber. This reduces the amount of the second replacement gas supplied from the supply source for keeping the inside of the chamber at a certain concentration of the replacement gas, thereby further reducing the amount of use of the second replacement gas.

The present invention also provides a filling-and-sealing method for filling a container with a content fluid and sealing the filled container, including: a first step of introducing a first replacement gas in a chamber into the container carried into the chamber as a covered space; a second step of replacing, in the chamber, a gas in the container with a second replacement gas based on a supply source outside the chamber; a third step of filling the container with the content fluid in the chamber; and a fourth step of sealing the container in the chamber.

As the second step of introducing the second replacement gas into the container, one or both of non-seal gassing and seal gassing may be selectively performed.

In the filling-and-sealing method according to the present invention, the second replacement gas is preferably introduced into the container filled with the content fluid by the third step before or during the fourth step.

In the filling-and-sealing method according to the present invention, when the first step, the second step, the third step, and the fourth step are repeated, the first replacement gas in the first step contains a part of the second replacement gas introduced in the prior second step, which is the second replacement gas leaking from the container.

Advantageous Effects of Invention

According to the present invention, an amount of use of a replacement gas supplied from a supply source and required for replacing air in a container can be reduced.

DESCRIPTION OF EMBODIMENTS

Now, with reference to the accompanying drawings, embodiments of the present invention will be described.

First Embodiment

Figure 1:
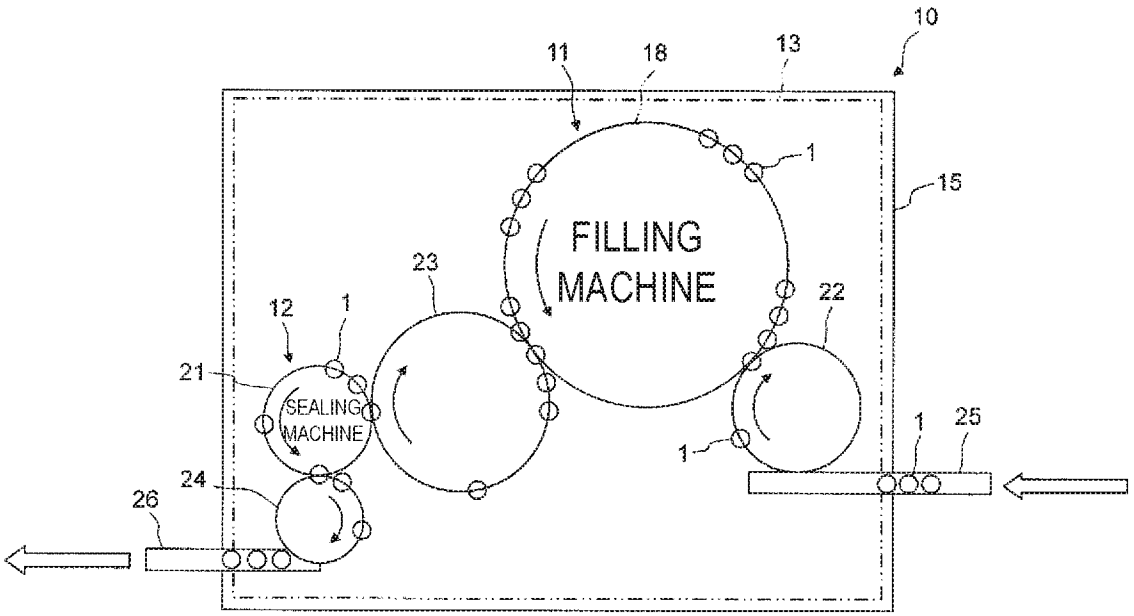
FIG. 1 is a schematic plan view of a filling-and-sealing device according to a first embodiment of the present invention.
Figure 2:
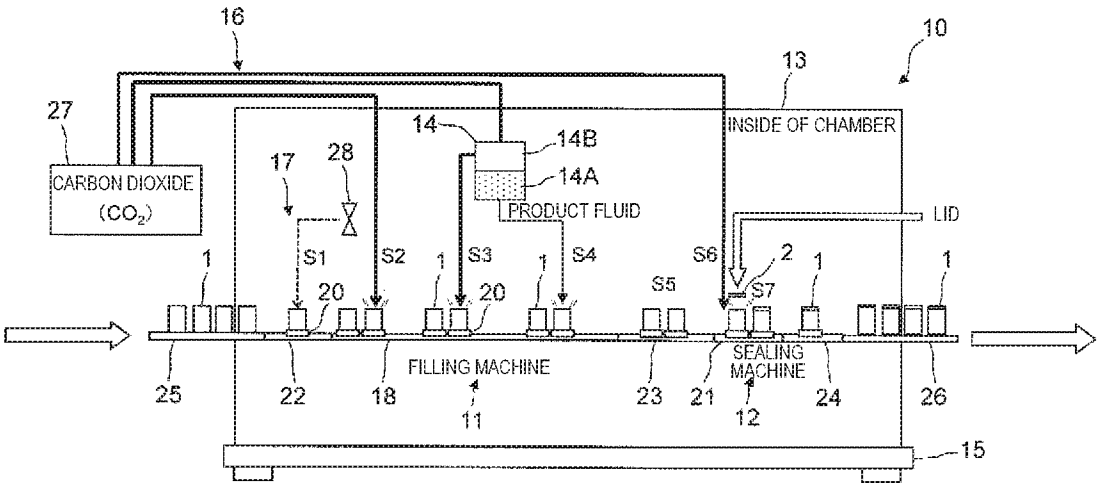
FIG. 2 is a schematic side view of the filling-and-sealing device in FIG. 1.

A filling-and-sealing device 10 shown in FIGS. 1 and 2 fills a container 1 with a content fluid and seals the container 1 while conveying the container 1.

The filling-and-sealing device 10 includes a filling machine 11 (filler), a sealing machine 12 (seamer), a chamber 13 that covers the filling machine 11 and the sealing machine 12, a base 15 that supports the filling machine 11 and the sealing machine 12, a gassing system 16 (FIG. 2), and a pre-gassing system 17 (FIG. 2).

The filling machine 11 includes a rotary conveying device including a rotor 18, and a filling nozzle (not shown) that fills the container 1 held by the rotor 18 with a content fluid. The filling nozzle is connected to a liquid-phase portion 14A in which the content fluid is stored in a filler bowl 14.

The container 1 is a cylindrical closed-end can, and is held in an erect position with an opening upward in a pocket 20 (FIG. 2) provided on an outer periphery of the rotor 18 at a certain pitch. The rotor 18 is rotated by a drive unit (not shown).

The sealing machine 12 is a rotary conveying device including a lifter 21, and a lid 2 (FIG. 2) is seamed to the container 1 held by the lifter 21 to seal the container 1.

The conveying device of the filling-and-sealing device 10 includes the rotor 18, the lifter 21, a supply star wheel 22 that supplies the container 1 to the filling machine 11, a transfer star wheel 23 that receives the container 1 from the filling machine 11 and transfers the container 1 to the sealing machine 12, and a discharge star wheel 24 that discharges the container 1 from the sealing machine 12.

Such a configuration of the conveying device is a mere example, and the number and arrangement of star wheels may be determined as appropriate.

Each star wheel that constitutes the conveying device has an appropriate diameter so as to meet a predetermined processing capacity of filling and sealing and prevent the content fluid from spilling out of the opening of the container 1 by a centrifugal force.

The conveying device of the filling-and-sealing device 10 is supported by the common base 15, and the entire filling-and-sealing device 10 is integrally configured. The base 15 herein has a rectangular shape on a plan view, and is provided on a floor of a building.

As shown in FIGS. 1 and 2, the chamber 13 is formed into a box shape so as to cover the entire conveying device (the rotor 18, the star wheels 22, 23, 24, the lifter 21) of the filling-and-sealing device 10 arranged together on the base 15, and provided on the base 15.

The chamber 13 contains a continuous space across the filling machine 11 and the sealing machine 12. The space inside the chamber 13 is referred to as the inside of the chamber 13. A transparent window may be provided in a part of the chamber 13 so as to be able to observe the inside of the chamber 13.

The container 1 having been washed in a previous step is introduced into the chamber 13 by a supply conveyor 25.

The supply conveyor 25 extends through inside and outside the chamber 13 through an inlet formed in the chamber 13. The container 1 held on the supply conveyor 25 passes through the inlet in the chamber 13 and is transferred to the supply star wheel 22.

The container 1 having been filled and sealed while being conveyed by the rotor 18, the lifter 21, or the like in the chamber 13 is discharged out of the chamber 13 by a discharge conveyor 26.

The discharge conveyor 26 also extends through inside and outside the chamber 13 through an outlet formed in the chamber 13. The container 1 held on the discharge conveyor 26 passes through the outlet in the chamber 13, and is then transferred to a post-step such as testing, labeling, or packaging.

The chamber 13 has three openings: the inlet for the container 1, the outlet for the container 1, and a lid supply port for carrying the lid 2 into the chamber 13. The chamber 13 is sealed except for these openings.

In order to increase a degree of sealing in the chamber 13, the opening in the chamber 13 may be closed by a flow of a liquid (for example, water) or a flow of a gas (for example, air, a replacement gas such as a carbon dioxide gas, a gas in the chamber 13). The liquid may include, for example, water, and the gas may include, for example, a second replacement gas such as a carbon dioxide gas, a first replacement gas in the chamber 13, or air. If water is used to close the opening in the chamber 13, the container 1 and the lid 2 carried into the chamber 13 may be washed with the water.

Figure 3:
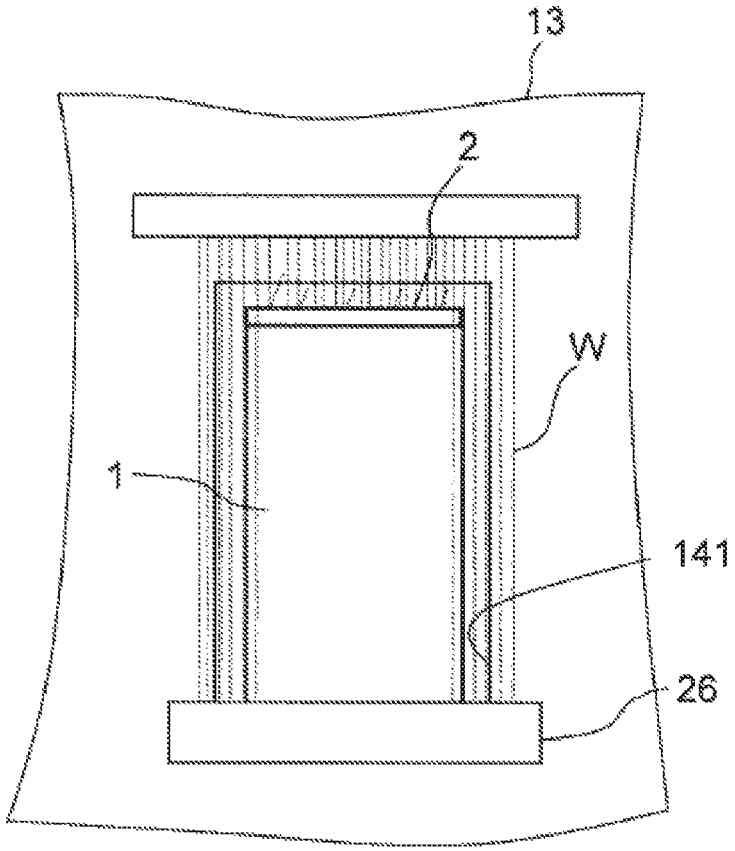
FIG. 3 shows an outlet for discharging a container out of a chamber.

For example, an outlet 141 in the chamber 13 shown in FIG. 3 is closed by a curtain-like flow of water W. The water W continuously discharged downward from a discharge port located above the container 1 forms the flow of water W along a vertical direction orthogonal to a conveying direction of the container 1 over the entire region of the outlet 141. The water W is discharged from a plurality of discharge ports arranged in a width direction of the supply conveyor 25 at intervals, or a slit extending along the width direction. The width direction of the supply conveyor 25 matches a lateral direction in FIG. 3.

At the outlet 141, the opening of the container 1 is sealed so that the water W does not flow into the container 1.

Similarly to that shown in FIG. 3, a curtain-like airflow may close the outlet 141.

The inlet in the chamber 13 may be closed by the curtain-like airflow or a curtain-like flow of water W. The water W having entered the container 1 may be discharged out of the container 1, for example, by inverting the container 1.

Whether the liquid or the gas is used for closing the opening in the chamber 13 may be selected as appropriate in consideration of whether or not the container 1 passing through the opening is sealed.

If the container 1 is filled with the content fluid with air existing in the container 1, an oxygen gas contained in the air in the container 1 is mixed in the content fluid, and quality of the content fluid may be impaired by the content fluid coming into contact with the oxygen gas. The same applies when the container 1 is sealed with the air remaining in a head space 1A (FIG. 4) above a fluid level, because the oxygen gas comes into contact with the content fluid.

Thus, it is effective that in filling and sealing, the gassing system 16 replaces the air in the container 1 with a replacement gas inactive to the content fluid, and remove the oxygen gas in the container 1 to a predetermined concentration or less. In particular, if the content fluid is a beer beverage such as beer or law-malt beer, the oxygen gas tends to impair quality, and there is a strong request to reduce the concentration of the oxygen gas in the container 1.

A carbon dioxide gas ($CO_2$) is typically used as the replacement gas, but a nitrogen gas ($N_2$) or water vapor ($H_2O$) may be used. The replacement gas corresponds to the second replacement gas in the present invention.

As specific examples, the air in the head space is replaced with the nitrogen gas for preventing oxidation of a non-gas beverage, or the air is replaced with water vapor or a mixture of the nitrogen gas and the water vapor when a can container is filled with a non-gas beverage.

In this embodiment, the carbon dioxide gas is used as the second replacement gas.

As shown in FIG. 2, the filling-and-sealing device 10 includes a tank 27 filled with a liquid-phase carbon dioxide, that is, a liquefied carbon dioxide gas as a supply source of the carbon dioxide gas. The carbon dioxide gas supplied from the tank 27 through the filler bowl 14 is blown into the container 1 by the gassing system 16. The tank 27 is connected to a gas-phase portion 14B in the filler bowl 14, and the liquefied carbon dioxide gas turns into a gas-phase carbon dioxide gas when being introduced into the gas-phase portion 14B.

The gassing system 16 (FIG. 2) includes a blowing nozzle that blows the carbon dioxide gas supplied from the tank 27, and a valve that opens/closes a flow path of the blowing nozzle. The nozzle and the valve are not shown. The nozzle and the valve may be provided integrally with the filling nozzle of the filling machine 11.

For a content fluid containing a carbon dioxide gas such as beer, a counter process for pressurizing the inside of the container 1 when filling, and a snifting process for discharging air to reduce pressure in the container 1 when drawing the filling nozzle out of the liquid are performed. Paths and valves required for these processes may be provided integrally with the filling nozzle.

In this embodiment, in the filling machine 11, the gassing system 16 sequentially performs non-seal gassing and seal gassing. The non-seal gassing is performed without the opening of the container 1 being closed, and the seal gassing is performed with the opening of the container 1 being closed by the filling nozzle of the filling machine 11.

The non-seal gassing rapidly reduces the concentration of the oxygen gas in the container 1, and then the seal gassing more sufficiently reduces the concentration of the oxygen gas in the container 1, thereby allowing the gas in the container 1 to be efficiently replaced with the carbon dioxide gas.

Further, in the sealing machine 12, undercover gassing is performed for blowing the carbon dioxide gas between the lid 2 and the container 1 and replacing the gas in the head space 1A in the container 1 with the carbon dioxide gas.

The non-seal gassing, the seal gassing, and the undercover gassing may be selectively performed by the gassing system 16 depending on types of the fluid.

A configuration of piping of the gassing system 16 may be determined as appropriate.

The carbon dioxide gas introduced into the container 1 by the gassing system 16 leaks from the container 1, for example, while the container 1 is transferred from the filling machine 11 to the sealing machine 12. Since the leaking carbon dioxide gas remains in the chamber 13, the chamber 13 contains the carbon dioxide gas having a higher concentration than the atmosphere. The concentration increases with increasing duration of an operation of the filling-and-sealing device 10.

The filling-and-sealing device 10 according to this embodiment has a main feature that, before the processing by the gassing system 16, the pre-gassing system 17 introduces the gas in the chamber 13 having a higher concentration of the carbon dioxide gas than the atmosphere into the container 1 as the first replacement gas in the present invention. The pre-gassing is performed for the container 1 carried into the chamber 13.

If the pre-gassing system 17 introduces the first replacement gas in the chamber 13 into the container 1 after the processing by the gassing system 16, and thus the gas in the container 1 into which the carbon dioxide gas as the second replacement gas has been blown by the gassing system 16 is replaced with the first replacement gas, the concentration of the carbon dioxide gas in the container 1 decreases. Alternatively, if the gas in the container 1 has been already replaced with the first replacement gas in the chamber 13 during conveyance of the container 1 after the processing by the gassing system 16, there is no need for performing the pre-gassing for introducing the first replacement gas in the chamber 13 into the container 1.

Thus, the pre-gassing is performed before the first processing by the gassing system 16, that is, the non-seal gassing in this embodiment.

The pre-gassing system 17 (FIG. 2) introduces the first replacement gas containing the second replacement gas composed of the carbon dioxide gas leaking from the container 1 and remaining in the chamber 13 into the container 1 before the gassing system 16 introduces the carbon dioxide gas.

To this end, the pre-gassing system 17 includes a blower 28 and a blowing nozzle (not shown).

The blower 28 is provided in the chamber 13 and sucks and pressurizes a surrounding gas.

The blowing nozzle feeds the first replacement gas delivered by the blower 28 into the container 1 before the processing by the gassing system 16.

In this embodiment, the pre-gassing system 17 feeds the first replacement gas in the chamber 13 into the container 1 held by the pocket 20 of the supply star wheel 22.

The pre-gassing system 17 blows the first replacement gas in the chamber 13 into the container 1 carried into the chamber 13 at any timing before the first processing by the gassing system 16. Before the first processing by the gassing system 16, the first replacement gas in the chamber 13 may be blown into the container 1 held by the rotor 18 of the filling machine 11.

Next, with reference to FIGS. 2 and 4, processes of filling and sealing by the filling-and-sealing device 10 will be described.

Figure 4:
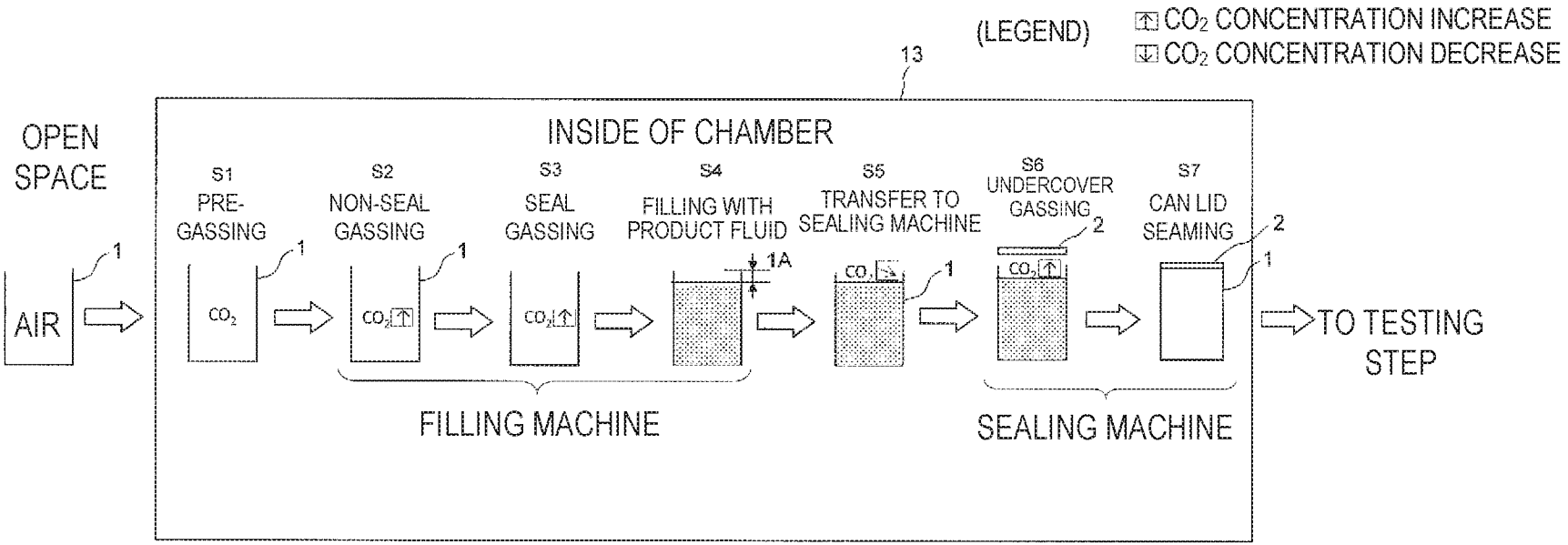
FIG. 4 shows processing steps of filling and sealing.

As the legend in FIG. 4, arrows enclosed by squares conceptually show that the processes change the concentration of the carbon dioxide gas in the container 1.

First, the supply conveyor 25 carrying the container 1 into the chamber 13 will be described.

Since a space around the chamber 13 is open to the atmosphere, the container 1 is filled with air (FIG. 4). The container 1 is carried into the chamber 13 by the supply conveyor 25 and transferred to the supply star wheel 22.

The pre-gassing system 17 blows the first replacement gas collected from the inside of the chamber 13 by the blower 28 and the blowing nozzle into the container 1 conveyed from the supply star wheel 22 (step S1: pre-gassing).

Then, the air in the container 1 is replaced with the first replacement gas in the chamber 13. The first replacement gas containing a carbon dioxide gas ($CO_2$) is introduced into the container 1 (FIG. 4).

The filling machine 11 that receives the container 1 via the supply star wheel 22 performs a process described below.

Descriptions on the counter process and the snifting process performed when the content fluid contains the carbon dioxide gas will be omitted.

The gassing system 16 blows the carbon dioxide gas as the second replacement gas supplied from the tank 27 into the container 1 without the opening being closed, the container 1 being held by the rotor 18 of the filling machine 11 (step S2: non-seal gassing). A flow of the carbon dioxide gas blown causes the gas in the container 1 to leak from the opening of the container 1, and also causes a part of the carbon dioxide gas blown to leak from the opening of the container 1.

The non-seal gassing rapidly replaces the gas in the container 1 with the carbon dioxide gas to increase the concentration of the carbon dioxide gas in the container 1.

Then, the opening of the container 1 is closed by the filling nozzle, a degassing path is ensured in the filling nozzle, and the gassing system 16 blows the carbon dioxide gas into the container 1 (step S3: seal gassing). The degassing path is open into the chamber 13.

The seal gassing further advances the replacement of the gas in the container 1 with the carbon dioxide gas, and the oxygen gas in the container 1 is more sufficiently removed.

The container 1 from which the oxygen gas is removed by the above is filled with the content fluid by the filling nozzle (step S4: filling with the content fluid).

At this time, when the container 1 is filled with the content fluid, the carbon dioxide gas of a volume equivalent to a volume of the content fluid returns to the gas-phase portion 14B in the filler bowl 14, but the carbon dioxide gas by an amount for snifting in the head space 1A leaks through the degassing path in the filling nozzle into the chamber 13. Thus, the carbon dioxide gas in the container 1 is replaced with the content fluid.

The container 1 filled with the content fluid is transferred from the rotor 18 of the filling machine 11 via the transfer star wheel 23 to the lifter 21 of the sealing machine 12 (step S5: transfer to the sealing machine).

If the carbon dioxide gas in the head space 1A in the container 1 leaks from the opening of the container 1 while the container 1 is transferred from the filling machine 11 to the sealing machine 12, the carbon dioxide gas in the head space 1A by an amount for leakage is replaced with the first replacement gas in the chamber 13. The example in FIG. 4 shows that the leakage during the transfer somewhat reduces the concentration of the carbon dioxide gas in the container 1.

Due to the carbon dioxide gas leaking from the container 1, the chamber 13 contains the carbon dioxide gas having a higher concentration than the atmosphere, thereby preventing a reduction in the concentration of the carbon dioxide gas in the head space 1A caused by the leakage from the container 1. Thus, the container 1 is supplied to the sealing machine 12 with the carbon dioxide gas remaining in the container 1.

The sealing machine 12 performs a process described below.

The lid 2 supplied into the chamber 13 is placed to face the opening of the container 1, and the gassing system 16 blows the carbon dioxide gas into a gap between the lid 2 and the container 1 (step S6: undercover gassing). Then, the flow of the carbon dioxide gas blows away the gas in the head space 1A, which is replaced with the carbon dioxide gas.

Immediately after the undercover gassing or during the undercover gassing, double seaming of the lid 2 to the container 1 lifted by the lifter 21 is performed to seal the container 1 (step S7: seaming).

In the processes of filling and sealing described above, the carbon dioxide gas supplied from the tank 27 and once introduced into the container 1 by the gassing system 16 leaks into the chamber 13 around the container 1.

The carbon dioxide gas leaking into the chamber 13 includes, for example, an excess of the carbon dioxide gas blown into the container 1 and flows out of the container 1 in the non-seal gassing (step S2), or a gas discharged from the degassing path in the seal gassing (step S3).

The carbon dioxide gas introduced into the container 1 by the non-seal gassing and the seal gassing leaks into the chamber 13 in the snifting process in filling (step S4) or the transfer (step S5). Then, in the undercover gassing (step S6), much of the carbon dioxide gas blown leaks into the chamber 13.

Specifically, the carbon dioxide gas exists around a conveying path of the container 1 in the filling-and-sealing device 10, and the first replacement gas containing the carbon dioxide gas remains in the chamber 13.

In this embodiment, the carbon dioxide gas leaking from the container 1 and remaining in the chamber 13 is blown into the container 1 by the pre-gassing system 17 (step S1). By the pre-gassing, the container 1 contains the carbon dioxide gas having a higher concentration than the atmosphere, and accordingly, an amount of the carbon dioxide gas supplied from the tank 27 can be reduced in next step S2 and step S3 of gassing. Specifically, in step S2 and step S3, a carbon dioxide gas by an amount for a shortage for obtaining the predetermined concentration of the carbon dioxide gas in the container 1 may be introduced into the container 1.

Even if a part of the carbon dioxide gas in the head space 1A in the container 1 is replaced with the gas in the chamber 13 when the container 1 is transferred from the filling machine 11 to the sealing machine 12, the concentration of the carbon dioxide gas in the chamber 13 is higher than in the atmosphere, and thus the concentration of the carbon dioxide gas is high in the head space 1A. By an increment of the concentration of the carbon dioxide gas, the amount of use of the carbon dioxide gas by the gassing system 16 can be reduced in step S6 of the undercover gassing.

According to this embodiment, almost all of the carbon dioxide gas leaking from the container 1 remains in the chamber 13, and the pre-gassing for blowing the gas in the chamber 13 into the container 1 is performed before the processing by the gassing system 16. Thus, according to this embodiment, the amount of use of the carbon dioxide gas supplied from the tank 27 is significantly reduced, and also the gas in the container 1 can be efficiently replaced to sufficiently reduce the concentration of the oxygen gas in the space and the content fluid in the container 1. The reduction in the amount of use of the carbon dioxide gas can reduce manufacturing cost, and contribute to safety in working environment and protection of natural environment.

Also, the gassing system 16 blows the carbon dioxide gas as the second replacement gas in the chamber 13 substantially sealed, and thus the inside of the chamber 13 is at positive pressure with respect to the outside of the chamber 13 under the atmospheric pressure, thereby preventing foreign matters such as dust or insects from entering the chamber 13 from outside.

Thus, there is no need to prepare a room with an adequate hygiene level for providing the filling-and-sealing device 10, thereby reducing capital investment and providing high flexibility in changing a device configuration of a manufacturing line.

The pre-gassing performed before the processing by the gassing system 16 is performed on the condition that the gas in the chamber 13 contains the carbon dioxide gas and the concentration of the carbon dioxide gas in the chamber 13 is higher than in the atmosphere.

Thus, at the beginning of the operation of filing and sealing by the filling-and-sealing device 10, the chamber 13 is filled with the atmosphere and thus the pre-gassing is not performed, and the pre-gassing is preferably started after the gas in the chamber 13 reaches a predetermined concentration of the carbon dioxide gas.

Also, at the beginning of the operation, the carbon dioxide gas may be previously introduced into the chamber 13 so that the concentration of the carbon dioxide gas in the chamber 13 is higher than in the atmosphere, and the pre-gassing may be performed from the beginning of the operation.

All the approaches are consistent in that the gas in the container 1 is replaced with the first replacement gas when the second replacement gas contained in the first replacement gas reaches a predetermined concentration.

In the pre-gassing for introducing the gas in the chamber 13 into the container 1, using the blower 28 is not required.

Figure 5:
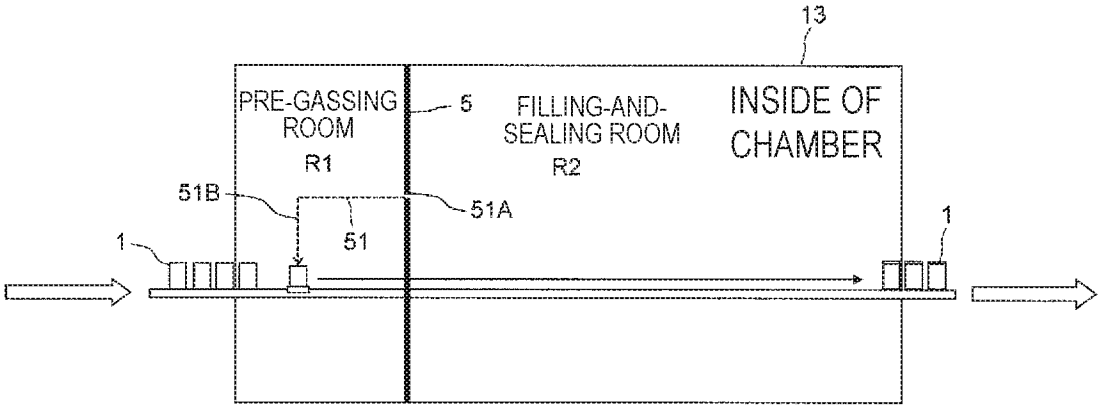
FIG. 5 is a schematic side view of a filling-and-sealing device according to a variant of the first embodiment.

The pre-gassing system 17 in an example in FIG. 5 includes a wall 5 that partitions the chamber 13, and a flow path 51 that provides communication between opposite sides of the wall 5.

The wall 5 separates a pre-gassing room R1 in which the processing by the pre-gassing system 17 is performed, and a filling-and-sealing room R2 in which the processing by the gassing system 16, filling with the content fluid, and sealing of the container are performed.

In the filling-and-sealing room R2, as described above, the carbon dioxide gas leaks from the container 1 in the gassing process or the snifting process and while the container 1 is transferred to the sealing machine 12. Thus, in the chamber 13, pressure in the filling-and-sealing room R2 is relatively high, and pressure in the pre-gassing room R1 is relatively low. Also, air outside the chamber 13 under the atmospheric pressure contained in the container 1 is brought into the pre-gassing room R1 together with the container 1. Also from this aspect, the pressure in the pre-gassing room R1 is relatively low.

Based on such a difference in pressure, the gas in the filling-and-sealing room R2 is fed through the flow path 51 into the pre-gassing room R1. The flow path 51 introduces the gas in the filling-and-sealing room R2 into the container 1 before subjected to the gassing process.

Like the pressure, the concentration of the carbon dioxide gas is relatively high in the filling-and-sealing room R2 and relatively low in the pre-gassing room R1. Thus, the gas in the filling-and-sealing room R2 containing a larger amount of carbon dioxide gas is efficiently fed into the container 1 in the pre-gassing room R1.

The flow path 51 shown in FIG. 5 includes a hole 51A extending through the wall 5 in a thickness direction, and a nozzle 51B that communicates with the hole 51A.

Not limited to this example, the flow path 51 may be constituted by any appropriate duct or nozzle. A part of the flow path 51 may be outside the chamber 13. For example, the flow path 51 may have a start end located in the filling-and-sealing room R2 and a terminal located in the pre-gassing room R1, and a section may extend outside the chamber 13 between the start end and the terminal. In that case, there is no need for the hole 51A in the wall 5.

Second Embodiment

Next, with reference to FIG. 6, a variant of the present invention will be described. The same configurations as in the embodiment described above are denoted by the same reference numerals.

In the first embodiment described above, the carbon dioxide gas as the second replacement gas is blown into the container 1 filled with air and introduced into the chamber 13, by the pre-gassing system 17 in the chamber 13. On the other hand, in a second embodiment shown in FIG. 6, the container 1 is introduced into the chamber 13 while the carbon dioxide gas is blown into the container 1 at a position where the container 1 is introduced into the chamber 13.

Figure 6:
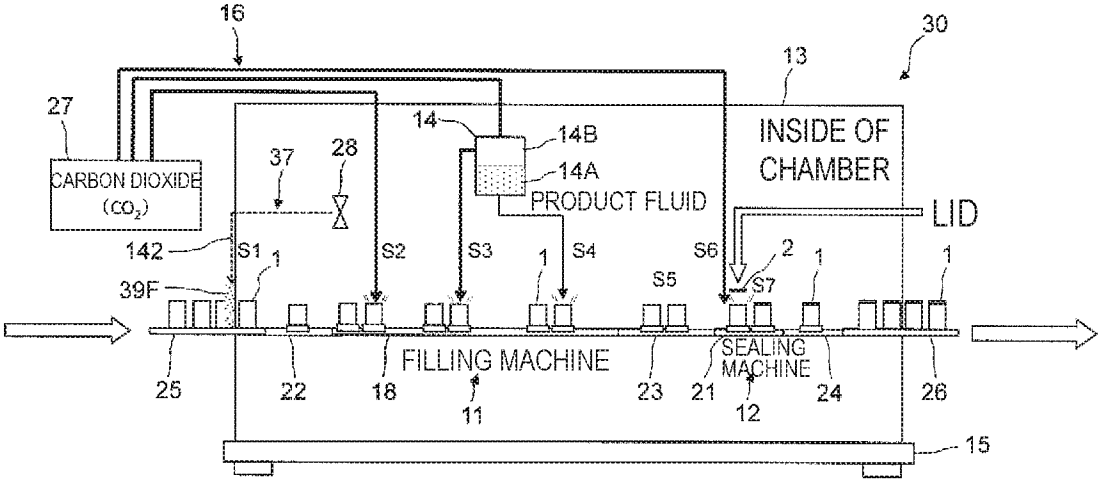
FIG. 6 is a schematic side view of a filling-and-sealing device according to a second embodiment of the present invention.

A pre-gassing system 37 included in a filling-and-sealing device 30 shown in FIG. 6 blows the gas in the chamber 13 into the container 1 erected on the supply conveyor 25 and between the containers 1 at a position of an inlet 142 in the chamber 13.

The inlet 142 provides communication between inside and outside the chamber 13, and is a position where the container 1 is introduced into the chamber 13.

The pre-gassing system 37 includes a blower 28 that sucks and feeds a first replacement gas in the chamber 13, and a plurality of blowing nozzles 29 (FIG. 7) connected to the blower 28 via ducts (not shown).

Figure 7:
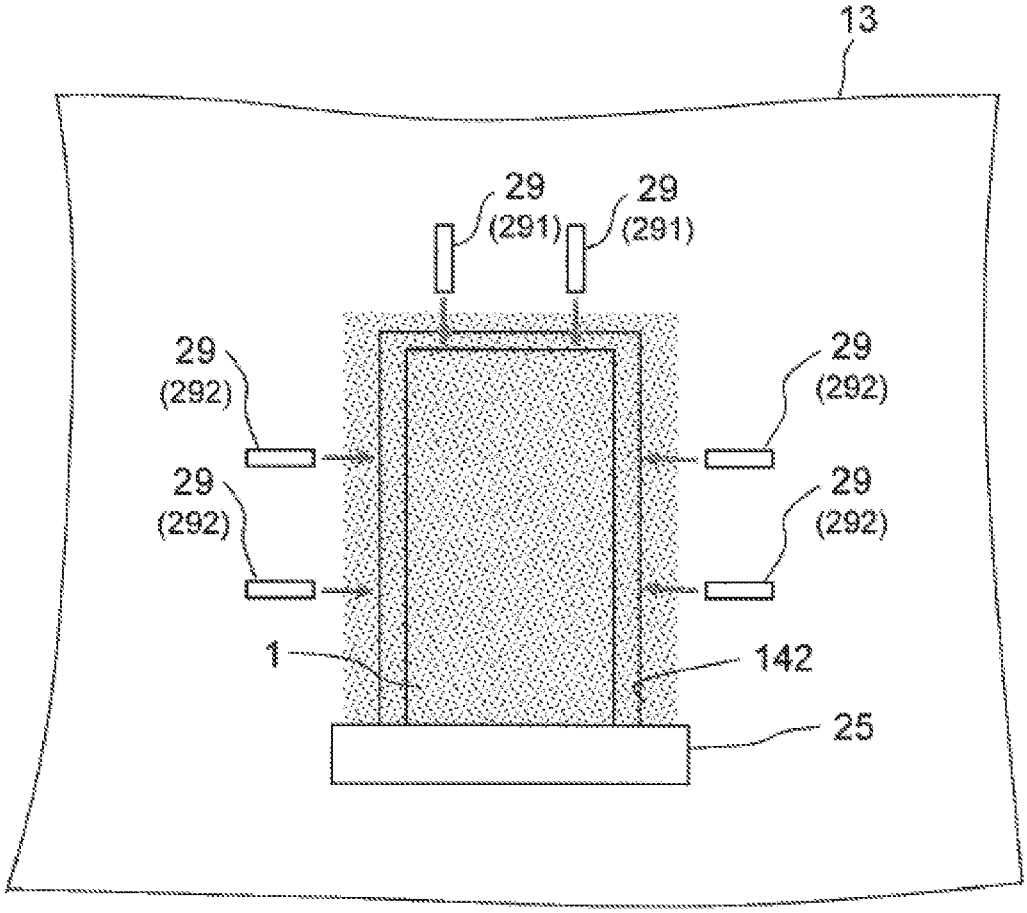
FIG. 7 shows an inlet for carrying the container into the chamber.

As shown in FIG. 7, the blowing nozzles 29 placed in the inlet 142 include a plurality of first nozzles 291 and a plurality of second nozzles 292. The first nozzle 291 feeds the first replacement gas from top downward into the container 1. The second nozzle 292 feeds the first replacement gas from opposite sides in a width direction of the supply conveyor 25 toward a gap between the containers 1 arranged on the supply conveyor 25 in a conveying direction. The blowing nozzles 29 (first nozzles 291 and second nozzles 292) form a curtain-like gas flow 39F.

The first replacement gas continuously blown out of the blowing nozzles 29 form the gas flow 39F over the entire region of the inlet 142.

The gas flow 39F prevents the gas in the chamber 13 from leaking from the inlet 142 out of the chamber 13, thereby increasing a degree of sealing in the chamber 13. Thus, the first replacement gas in the chamber 13 can be reliably introduced into the container 1 by the blower 28 and the blowing nozzle provided in the chamber 13, thereby allowing the inside of the chamber 13 to be reliably kept at positive pressure.

When the container 1 is introduced into the chamber 13, the air in the container 1 and also the air between the containers 1, 1 adjacent in the conveying direction are replaced with the first replacement gas in the chamber 13 blown from the blowing nozzle of the pre-gassing system 37.

This can prevent the introduction of the container 1 into the chamber 13 from bringing the air into the chamber 13. Thus, only a small amount of the carbon dioxide gas, that is, the second replacement gas may be used for keeping the inside of the chamber 13 at a certain concentration of the carbon dioxide gas, thereby further reducing the amount of the carbon dioxide gas supplied from the tank 27.

As the blowing nozzle 29 of the pre-gassing system 37, only the first nozzles 291 that blow the gas from top downward may be provided, but a combination of the first nozzles 291 that blow the gas from top downward and the second nozzles 292 that blow the gas from opposite sides of the supply conveyor 25 in the width direction allows the gas to be more reliably blown between the containers 1, 1. The second nozzle 292 may be provided on only one side in the width direction. The first replacement gas may be not only continuously blown but also intermittently blown from the blowing nozzle 29.

Even if the pre-gassing system 37 blows the gas in the chamber 13 only into the container 1, the amount of air brought into the chamber 13 is reduced by a volume of each container 1 carried into the chamber 13, thereby contributing a reduction in the amount of use of the carbon dioxide gas.

Third Embodiment

Next, with reference to FIG. 8, a third embodiment of the present invention will be described.

The third embodiment has a feature that the first replacement gas in the chamber 13 is blown at a position where the lid 2 is introduced into the chamber 13.

Figure 8:
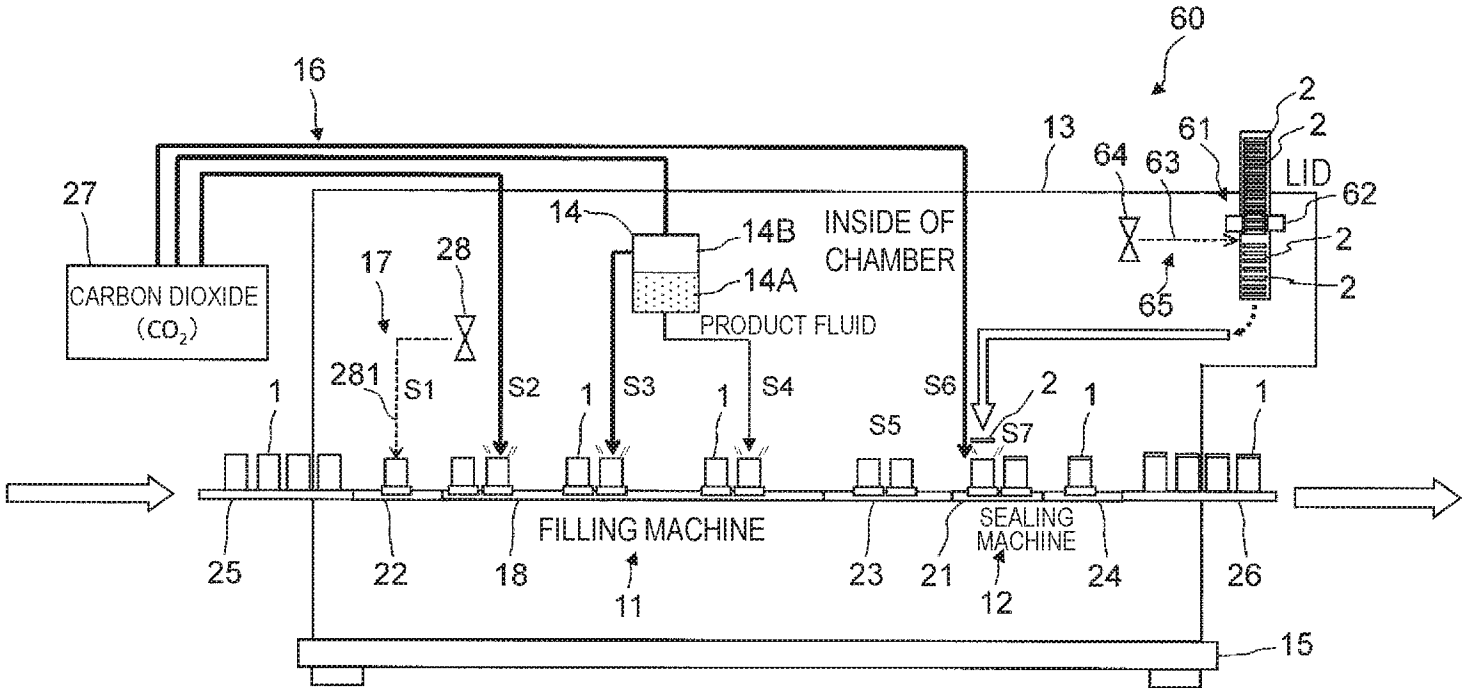
FIG. 8 is a schematic side view of a filling-and-sealing device according to a third embodiment of the present invention.

A filling-and-sealing device 60 in FIG. 8 includes a lid supply portion 61 (lid shooter) that supplies the lid 2 into the chamber 13. The lid supply portion 61 corresponds to the position where the lid 2 is introduced into the chamber 13.

The lid supply portion 61 includes a brake 62 that brakes the lids 2 conveyed in a tightly stacked state, and a nozzle 63 that blows the first replacement gas in the chamber 13 into a gap between the lids 2 created by braking.

The nozzle 63 introduces the first replacement gas fed from a blower 64 provided in the chamber 13 between the lids 2 from a lateral side of the lids 2.

The nozzle 63 and the blower 64 constitute a lid introducing portion gassing system 65.

The gas flow composed of the first replacement gas blown out of the nozzle 63 prevents the gas in the chamber 13 from leaking from the lid supply portion 61 out of the chamber 13, thereby increasing a degree of sealing in the chamber 13. Thus, the first replacement gas in the chamber 13 can be reliably introduced into the position where the lid 2 is introduced, by the blower 64 and the nozzle 63, thereby allowing the inside of the chamber 13 to be reliably kept at positive pressure.

The air between the lids 2, 2 is replaced with the first replacement gas in the chamber 13 blown out of the nozzle 63 of the lid introducing portion gassing system 65, thereby preventing supply of the lid 2 into the chamber 13 from bringing the air into the chamber 13. This reduces the amount of the carbon dioxide gas used for keeping the inside of the chamber 13 at a certain concentration of the carbon dioxide gas, thereby further reducing an amount of the carbon dioxide gas as the second replacement gas supplied from the tank 27.

In the example shown in FIG. 8, the lid introducing portion gassing system 65 and the pre-gassing system 17 each have an independent flow path for introducing the first replacement gas in the chamber 13, but the flow paths may be unitized in a partial section. For example, the lid introducing portion gassing system 65 and the pre-gassing system 17 may share the blower 28, pre-gassing of the container 1 through the nozzle 281 may be performed with the first replacement gas in the chamber 13 delivered by the blower 28, and the first replacement gas may be blown into the lid supply portion 61 through the nozzle 63.

Even if the third embodiment does not include the pre-gassing system 17 but includes only the lid introducing portion gassing system 65, the lid introducing portion gassing system 65 introduces the carbon dioxide gas into the lid supply portion 61, thereby reducing the amount of use of the carbon dioxide gas.

Using the blower 64 is not required for blowing the first replacement gas in the chamber 13 into the lid supply portion 61. Although not shown, in the chamber 13, a wall separates a lid supply room in which the lid supply portion 61 is placed and a filling-and-sealing room in which the processing by the gassing system 16, filing with the content fluid, and sealing of the container are performed, and based on a difference in pressure between the rooms, the first replacement gas in the filling-and-sealing room can be fed into the lid supply room.

This is the same idea as that shown in FIG. 5. The lid supply room herein corresponds to the pre-gassing room R1 in FIG. 5, the filling-and-sealing room corresponds to the filling-and-sealing room R2 in FIG. 5. The wall that partitions the chamber 13, and a flow path that provides communication between opposite sides of the wall may constitute the lid introducing portion gassing system 65.

Figure 9:
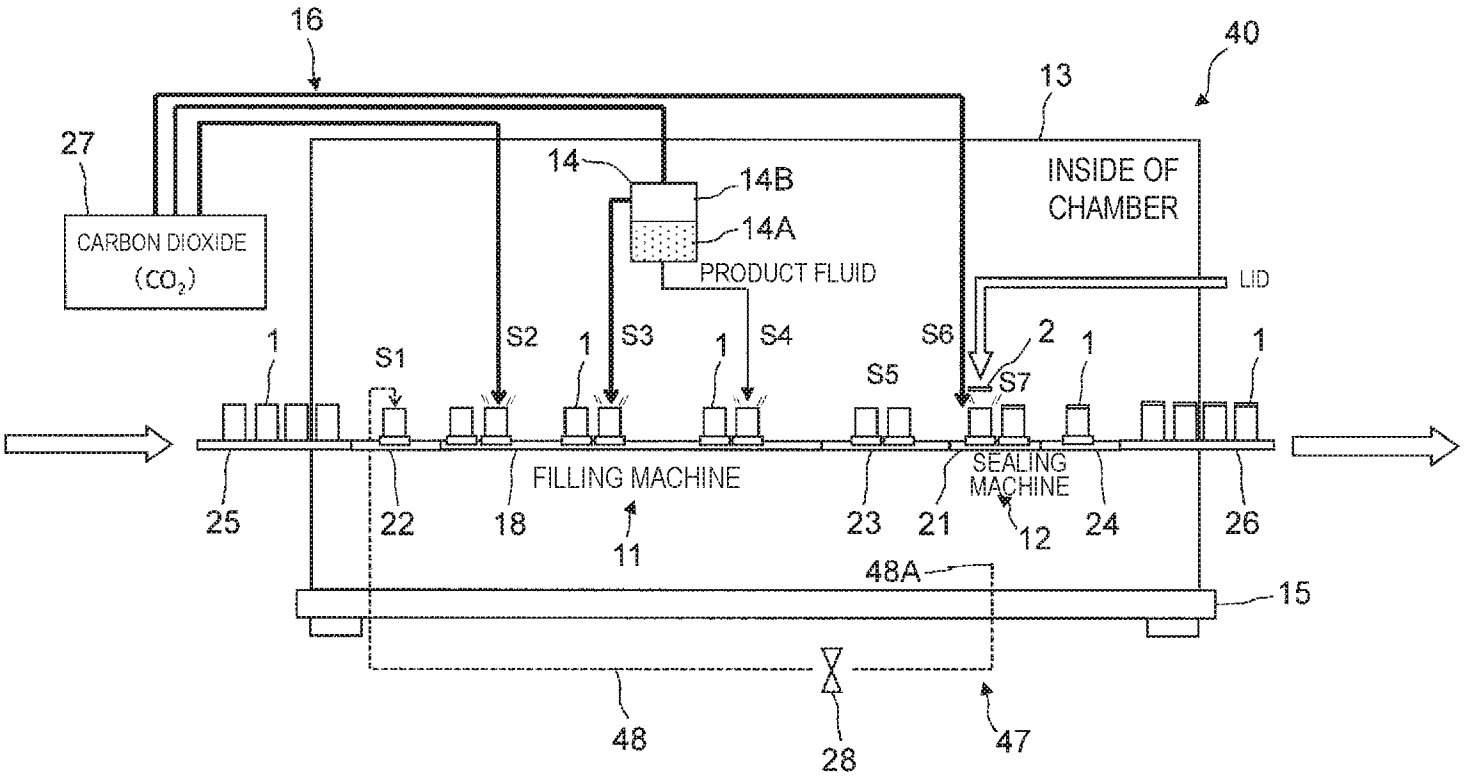
FIG. 9 is a schematic side view of a filling-and-sealing device according to a variant of the present invention.

FIG. 9 shows a variant of the present invention.

As shown in FIG. 9, the pre-gassing system in the present invention may once suck the first replacement gas in the chamber 13 out of chamber 13 and feeds the first replacement gas into the container 1.

A pre-gassing system 47 shown in FIG. 9 includes a flow path 48 connected to the chamber 13, a blower 28 provided in the flow path 48, and a blowing nozzle (not shown) connected to the flow path 48. The flow path 48 is connected to the blowing nozzle around the chamber 13.

When the blower 28 is actuated, the first replacement gas in the chamber 13 is sucked into the flow path 48 and fed to the blowing nozzle, and introduced from the blowing nozzle into the container 1.

In order for the first replacement gas in the chamber 13 to circulate through the flow path 48, one end 48A of the flow path 48 through which the first replacement gas in the chamber 13 is sucked is placed away from the blowing nozzle that feeds the first replacement gas into the container 1. If there is a gradient of the concentration of the carbon dioxide gas in the chamber 13, the carbon dioxide gas easily accumulates in the chamber 13, and providing the one end 48A of the flow path 48 in a position with a high concentration of the carbon dioxide gas can increase a rate of replacement of the gas in the container 1 with the carbon dioxide gas by the pre-gassing.

The chamber 13 according to the present invention is not limited to one covering the entire conveying device of the filling-and-sealing device, but may cover at least the container 1 and therearound in the processes from the first gassing (non-seal gassing) by the gassing system 16 to the sealing of the container 1.

The shape of the chamber 13 is not limited to the box shape but may be determined as appropriate.

Figure 10:
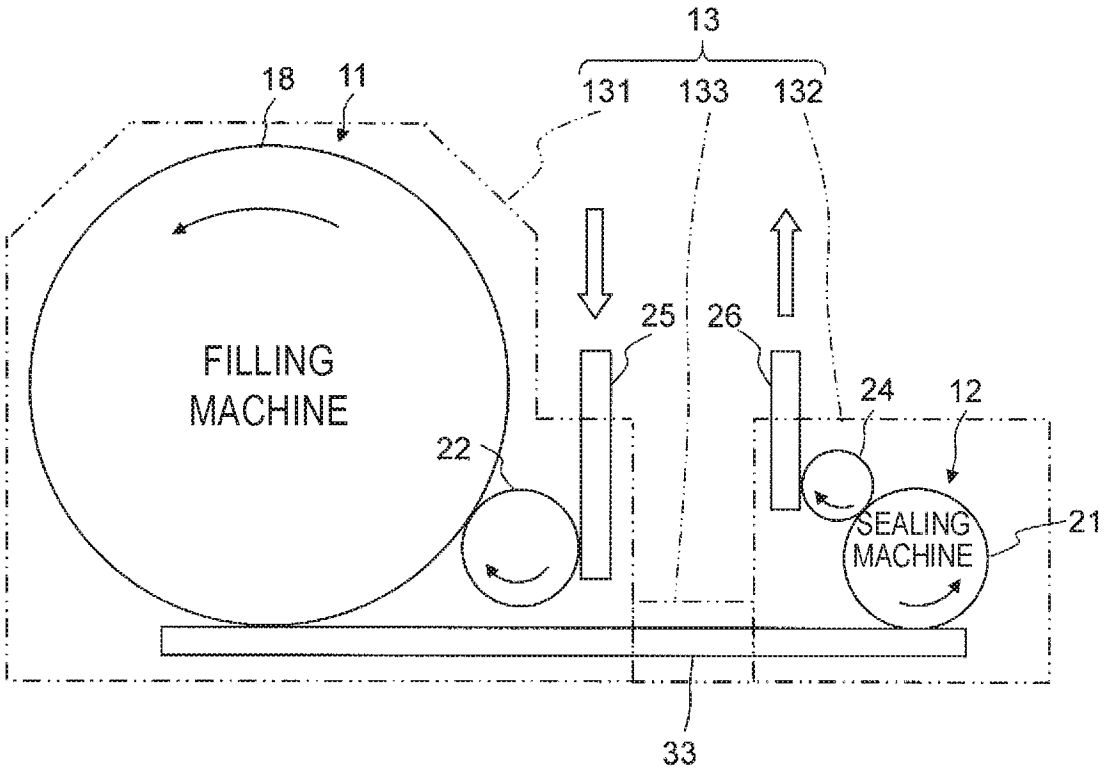
FIG. 10 is a schematic plan view of a filling-and-sealing device according to another variant of the present invention.

The chamber 13 in FIG. 10 includes a chamber portion 131 that covers the filling machine 11, a chamber portion 132 that covers the sealing machine 12, and a chamber portion 133 that covers a transfer conveyor 33 that transfers the container 1 from the filling machine 11 to the sealing machine 12. The chamber portion 131 communicates with the chamber portion 132 through the chamber portion 133, and a continuous space is formed in the chamber portions 131, 133, 132.

Since the carbon dioxide gas as the second replacement gas leaking from the container 1 everywhere in the processes of filling and sealing remains in the chamber 13 that wholly covers the filling machine 11 and sealing machine 12, the carbon dioxide gas may be collected by the pre-gassing system and used for replacing air in the container 1.

In addition, without departing from the gist of the present invention, the configurations described in the embodiments may be selected or changed as appropriate to other configurations.

The container in the present invention is not limited a can, but may be a PET bottle or a glass bottle. Such containers are sealed by respective appropriate methods.

The lid for sealing the container may be integrally provided with an unfilled container (container body) and supplied into the chamber together with the container body, or the lid may be supplied into the chamber separately from the container body.

If the lid is separate from the container body, as shown in FIG. 8, the first replacement gas in the chamber 13 is blown into the lid supply portion 61 in a container supply portion 61, thereby increasing a degree of sealing in the chamber 13, and reducing the amount of air brought from outside the chamber 13 into the chamber 13. This allows the carbon dioxide gas as the second replacement gas contained in the first replacement gas that remains in the chamber 13 to be used without any waste.

The lid 2, that is, a packaging material for sealing the container 1 includes a can lid, also a bottle cap, or a film that seals an opening of a container body. A structure of the lid supply portion 61 changes depending on types of the lid 2. If the lid supply portion 61 includes a separator for cutting the lids 2 one by one, the gas in the chamber 13 may be fed through the nozzle 63 into a gap created between the lids 2 by the separator.

For the bottle cap, the gas in the chamber 13 may be fed through the nozzle 63 into a cap shooter that carries the cap into the chamber 13.

The content fluid that fills the container 1 may include, not limited to beer or beer beverages, all kinds of alcohol and beverages such as Japanese sake, foreign liquors, coffee beverages, fruit juice beverages, tea beverages. The present invention is applicable to such alcohol and beverages of which oxidation should be avoided.

Also, the content fluid filling the container is not limited to beverages, but may be any content fluid that needs quality preservation by use of a replacement gas.

REFERENCE SIGNS LIST

1 container
1A head space
2 lid
5 wall
10 filling-and-sealing device
11 filling machine
12 sealing machine
13 chamber
14 filler bowl
15 base
16 gassing system
17 pre-gassing system
18 rotor
20 pocket
21 lifter
22 supply star wheel
23 transfer star wheel
24 discharge star wheel
25 supply conveyor
26 discharge conveyor
27 tank (supply source)
28 blower
29 blowing nozzle
30 filling-and-sealing device
37 pre-gassing system
39F gas flow
40 filling-and-sealing device
48 flow path
51 flow path
60 filling-and-sealing device
61 lid supply portion
62 brake
63 nozzle
64 blower
65 lid introducing portion gassing system
131, 132, 133 chamber portion
141 outlet
142 inlet
S1 step (first step)
S2 step (second step)
S3 step (second step)
S4 step (third step)
S5 step
S6 step (fourth step)
S7 step
W water

The invention claimed is:

1. A filling-and-sealing device comprising:

a filling machine configured to fill a container with a content fluid;

a sealing machine configured to seal the container transferred from the filling machine;

a chamber covering the filling machine and the sealing machine, and including an inlet and an outlet configured to pass the container through the chamber;

closing devices formed at the inlet and the outlet of the chamber, said closing devices closing the inlet and the outlet of the chamber by means of a fluid flow;

a gassing system configured to replace, in the chamber, a gas in the container with a second replacement gas based on a supply source outside the chamber; and a pre-gassing system configured to introduce a first replacement gas toward an opening of the container and to replace the gas in the container with the first replacement gas, before processing by the gassing system, wherein the first replacement gas contains the second replacement gas leaking from each other container preceding the container and remaining in the chamber when the gassing system replaces the gas in each other container with the second replacement gas.

2. The filling-and-sealing device according to claim 1, wherein the pre-gassing system is configured to replace the gas in the container with the first replacement gas when the second replacement gas contained in the first replacement gas reaches a predetermined ratio with respect to the first replacement gas.

3. The filling-and-sealing device according to claim 1, further comprising a lid introducing portion gassing system configured to introduce the first replacement gas into a position where a lid for sealing the container is carried into the chamber.

4. The filling-and-sealing device according to claim 1, wherein the chamber further includes a lid supply port configured to carry a lid for sealing the container into the chamber, and at least the inlet and the outlet are closed by means of a flow of a liquid or a gas.

5. The filling-and-sealing device according to claim 1, wherein the chamber includes a first chamber portion covering the filling machine, and a second chamber portion separated from the first chamber portion and covering the sealing machine.

6. The filling-and-sealing device according to claim 1, wherein the filling machine is arranged between the pre-gassing system and the sealing machine, the sealing machine is configured to replace the gas in a head space of the container filled with the content fluid by the filling machine, with the second replacement gas supplied from the supply source outside the chamber, and the first replacement gas further contains the second replacement gas leaking from the head space of each of other containers preceding the container and remaining in the chamber when the sealing machine replaces the gas in the head space of each of other containers with the second replacement gas.

7. The filling-and-sealing device according to claim 1, wherein the pre-gassing system includes a blower configured to suck the first replacement gas that remains in the chamber, and a nozzle configured to feed the first replacement gas delivered by the blower into the container.

8. The filling-and-sealing device according to claim 7, wherein the first replacement gas sucked by the blower in the chamber flows in a flow path passing through an outside of the chamber toward the nozzle.

9. The filling-and-sealing device according to claim 1, wherein the pre-gassing system is configured to introduce the first replacement gas into the container at a position where a plurality of the containers are continuously carried into the chamber.

10. The filling-and-sealing device according to claim 9, wherein the pre-gassing system is also configured to introduce the first replacement gas between the containers adjacent in a carrying direction at the position where the container is carried into the chamber.

11. A filling-and-sealing device comprising:

a filling machine configured to fill a container with a content fluid;

a sealing machine configured to seal the container transferred from the filling machine with a lid;

a chamber covering the filling machine and the sealing machine, and including an inlet and an outlet configured to pass the container through the chamber;

closing devices formed at the inlet and the outlet of the chamber, said closing devices closing the inlet and the outlet of the chamber by means of a fluid flow;

a gassing system configured to replace, in the chamber, a gas in the container with a second replacement gas based on a supply source outside the chamber; and a lid introducing portion gassing system configured to introduce a first replacement gas in the chamber, into a position where a lid for sealing the container is carried into the chamber, wherein the first replacement gas contains the second replacement gas leaking from each other container preceding the container and remaining in the chamber when the gassing system replaces the gas in each other container with the second replacement gas.

12. The filling-and-sealing device according to claim 11, wherein the chamber further includes a lid supply port configured to carry the lid into the chamber, and at least the inlet and the outlet are closed by means of a flow of a liquid or a gas.

13. The filling-and-sealing device according to claim 11, wherein the sealing machine is configured to replace the gas in a head space of the container filled with the content fluid by the filling machine, with the second replacement gas supplied from the supply source outside the chamber, and the first replacement gas further contains the second replacement gas leaking from the head space of each of other containers preceding the container and remaining in the chamber when the sealing machine replaces the gas in the head space of each of other containers with the second replacement gas.

14. A filling-and-sealing method for filling a container with a content fluid and sealing the container filled with the content fluid, comprising:

a preliminary step of closing an inlet and an outlet of a chamber by means of a fluid flow, and transferring the container into the chamber through the inlet;

a first step of introducing a first replacement gas in the chamber toward an opening of the container carried into the chamber;

a second step of replacing, in the chamber, a gas in the container with a second replacement gas based on a supply source outside the chamber;

a third step of filling the container with the content fluid in the chamber;

a fourth step of sealing the container in the chamber; and a final step of discharging the container from the chamber through the outlet.

15. The filling-and-sealing method according to claim 14, wherein the second replacement gas is introduced into the container filled with the content fluid in the third step, before or during the fourth step.

16. The filling-and-sealing method according to claim 14, wherein the first step, the second step, the third step, and the fourth step are repeated, and the first replacement gas in the first step contains a part of the second replacement gas leaking from each of other containers preceding the container and remaining in the chamber in the second step that has been executed before the first step of introducing the first replacement gas toward the opening of the container.

17. The filling-and-sealing method according to claim 14, wherein the chamber further includes a lid supply port that carries a lid for sealing the container into the chamber, in the preliminary step, at least the inlet and the outlet of the chamber are closed by means of a flow of a liquid or a gas, and the first step, the second step, the third step, and the fourth step are conducted while at least the inlet and the outlet of the chamber are closed.

18. The filling-and-sealing method according to claim 14, further comprising, between the third step and the fourth step, a replacing step of replacing the gas in a head space of the container filled with the content fluid in the third step, with the second replacement gas supplied from the supply source outside the chamber, wherein the first step, the second step, the third step, the replacing step, and the fourth step are repeated, and the first replacement gas in the first step contains the second replacement gas leaking from each of other containers preceding the container and remaining in the chamber in the second step and the replacing step that have been executed before the first step of introducing the first replacement gas toward the opening of the container.

* * * * *